US011141983B2

(12) United States Patent
Black et al.

(10) Patent No.: US 11,141,983 B2
(45) Date of Patent: Oct. 12, 2021

(54) PRINT FLUID TANK

(71) Applicant: HEWLETT-PACKARD DEVELOPMENT COMPANY, L.P., Spring, TX (US)

(72) Inventors: William Black, Leixlip (IE); Declan Malone, Leixlip (IE); Susan Henry, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 69 days.

(21) Appl. No.: 16/636,218

(22) PCT Filed: Aug. 7, 2017

(86) PCT No.: PCT/US2017/045697
§ 371 (c)(1),
(2) Date: Feb. 3, 2020

(87) PCT Pub. No.: WO2019/032084
PCT Pub. Date: Feb. 14, 2019

(65) Prior Publication Data

US 2020/0398576 A1 Dec. 24, 2020

(51) Int. Cl.
*B41J 2/175* (2006.01)
*B41J 2/19* (2006.01)

(52) U.S. Cl.
CPC ..... *B41J 2/17506* (2013.01); *B41J 2/17513* (2013.01); *B41J 2/17596* (2013.01); *B41J 2/19* (2013.01)

(58) Field of Classification Search
CPC ..... B41J 2/17506; B41J 2/17509; B41J 2/17513; B41J 2/17596; B41J 2/19
See application file for complete search history.

(56) References Cited

U.S. PATENT DOCUMENTS

| | | | |
|---|---|---|---|
| 6,733,117 | B2 | 5/2004 | Tajima et al. |
| 9,290,001 | B2 | 3/2016 | Kudo et al. |
| 9,421,779 | B2 | 8/2016 | Mokhamad et al. |
| 9,493,010 | B2 | 11/2016 | Kudo et al. |

(Continued)

FOREIGN PATENT DOCUMENTS

| | | | |
|---|---|---|---|
| EP | 3162573 | A1 | 5/2017 |
| JP | 2007106019 | A | 4/2007 |

OTHER PUBLICATIONS

Sethi, R., Brother DCP T500w Ink Tank Color Inkjet Printer Review, Nov. 4, 2015 < http://www.techmagnifier.com/reviews/brother-dcp-t500w-ink-tank-color-inkjet-printer> (6 pages).

*Primary Examiner* — Anh T Vo
(74) *Attorney, Agent, or Firm* — Trop Pruner & Hu PC

(57) ABSTRACT

An apparatus to supply print fluid (9) to a print fluid delivery system (28) of a printer, the apparatus comprising a tank (4) to store print fluid (9); a print fluid supply conduit (12) coupled to the tank (4) to supply print fluid (9) to the print fluid delivery system (28); and a vent conduit (10) extending from the tank (4); the tank (4) movable from a first position to supply print fluid (9) and in which first position the print fluid supply conduit (12) and vent conduit (10) are open to a second position to permit filling of the tank (4) and in which movement to the second position closes the print fluid supply conduit (12) and vent conduit (10).

20 Claims, 3 Drawing Sheets

(56) References Cited

U.S. PATENT DOCUMENTS

| | | | | |
|---|---|---|---|---|
| 9,505,223 | B2 | 11/2016 | Shumizu et al. | |
| 2010/0026753 | A1* | 2/2010 | Kuroda et al. | B41J 2/16547 |
| 2014/0085391 | A1 | 3/2014 | Chung-Hsin | |
| 2017/0120617 | A1* | 5/2017 | Matsumura et al. | B41J 2/17596 |

* cited by examiner

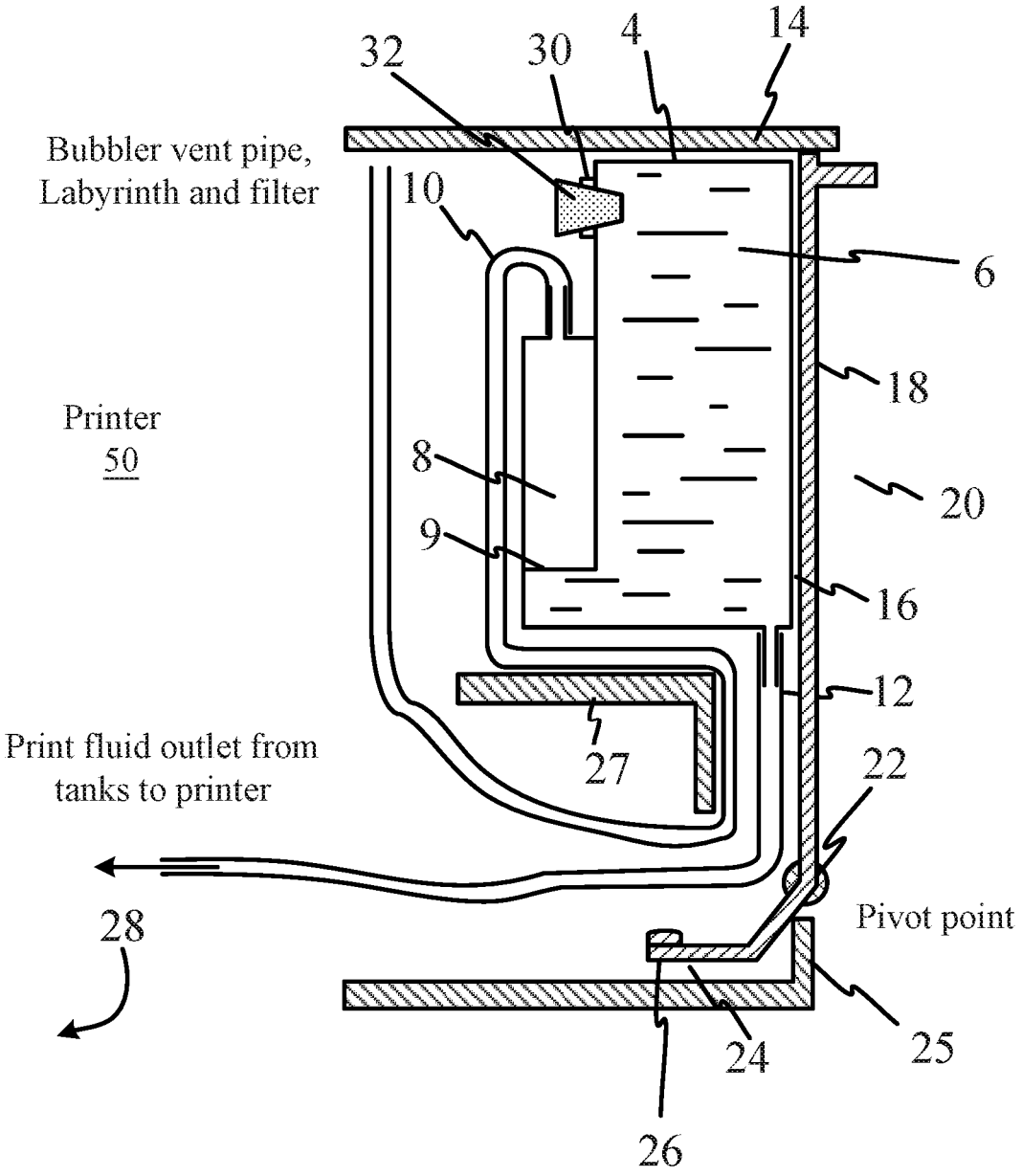
*FIG. 1*
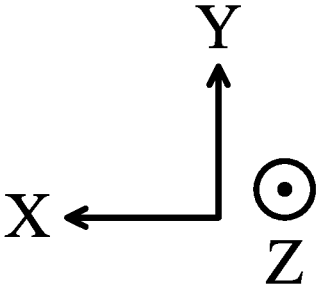

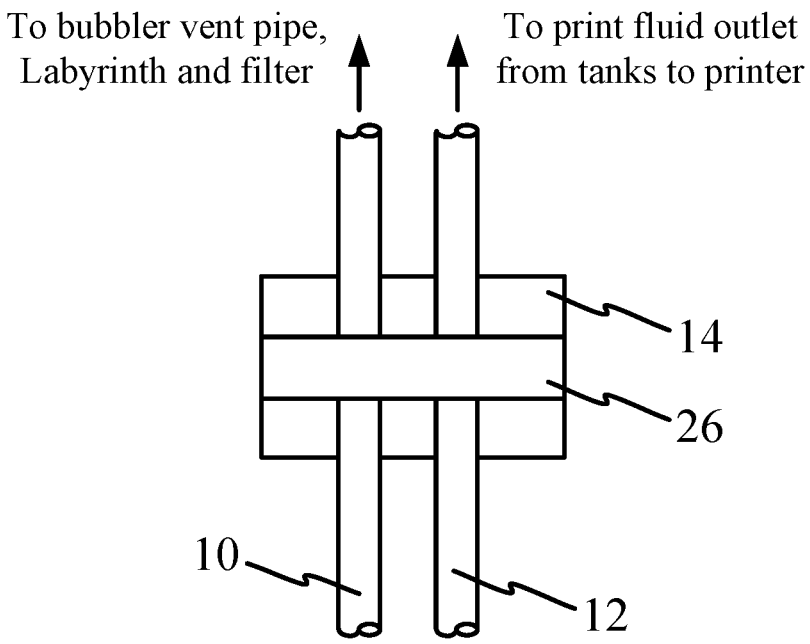
*FIG. 3*
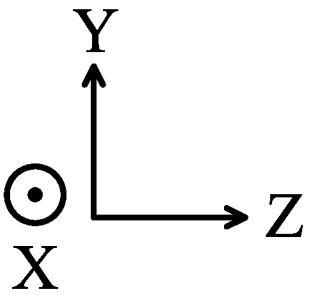

PRINT FLUID TANK

BACKGROUND

In a continuous print fluid supply system the user or an operator is relied upon to open and close various valves in a specific sequence during the print fluid refill process in order to maintain a constant back pressure in the continuous print fluid supply system. If the valves are not closed or opened in accordance with the sequence during the refill process the back pressure may be altered resulting in the system being reset by the user or operator, for example by resetting the bubbler chamber. In many systems resetting the system involves a complex operation involving closing and opening various valves and bond connections which can be very complicated.

LIST OF FIGURES

For a more complete understanding of the present disclosure, reference is now made to the following description taken in conjunction with the accompanying drawings provided by way of example and in which:

FIG. 1 is an illustrative schematic diagram of a print fluid tank of a bubbler type in the normal position in accordance with the present disclosure;

FIG. 3 is an illustrative schematic diagram of the print fluid supply pipes and air vent pipes in accordance with the present disclosure.

DESCRIPTION

Figure 2:
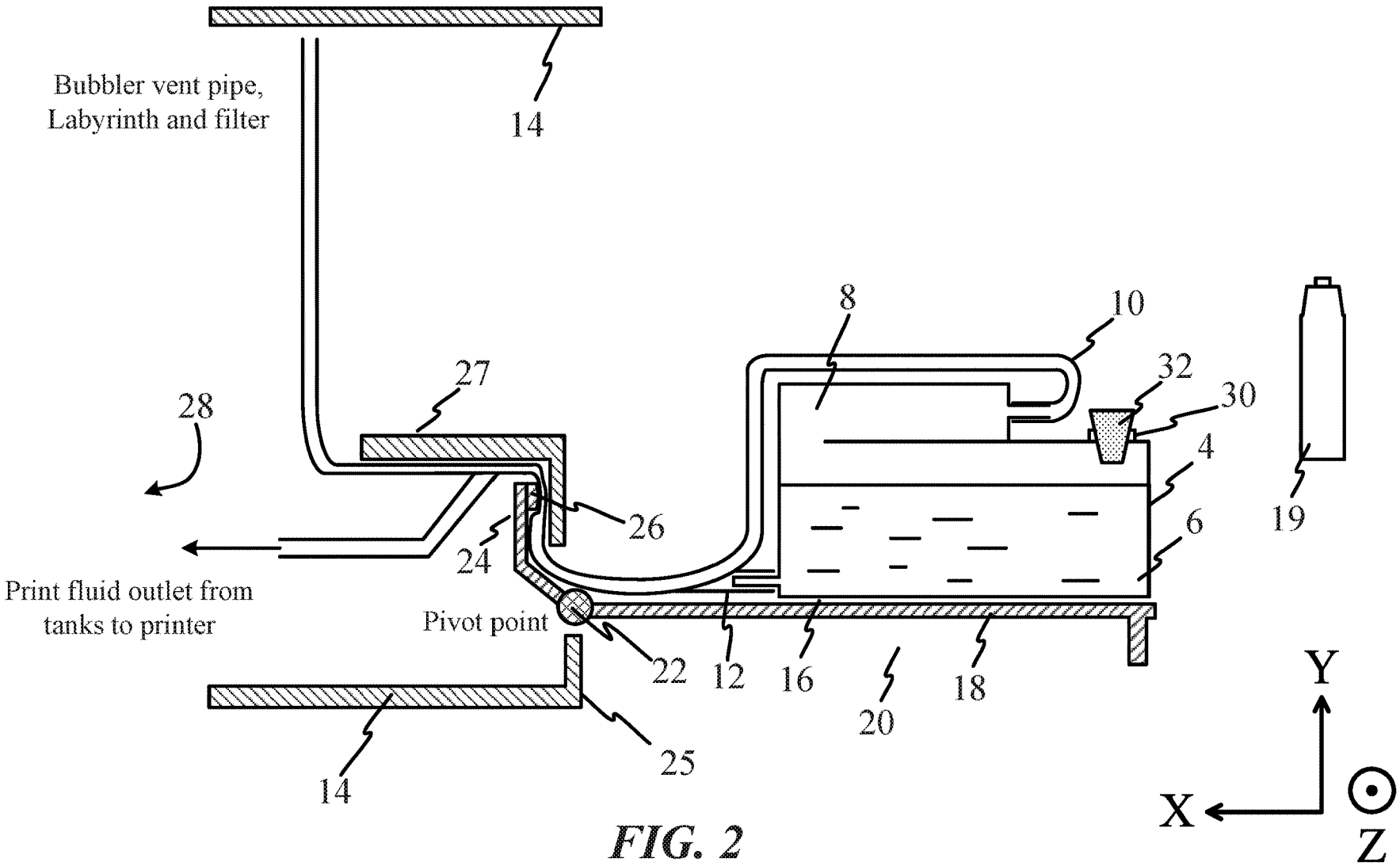
FIG. 2 is an illustrative schematic diagram of a print fluid tank of a bubbler type in the fill position in accordance with the present disclosure.

In the described disclosure a print fluid tank is presented. FIG. 1 is an illustrative schematic diagram of a print fluid storage tank 4 in normal operating position. Print fluid storage tank 4 is of a bubbler type which has a main tank 6 and a bubbler tank 8 with a vent pipe 10 venting to atmosphere. A print fluid supply conduit 12 extends from the main tank 6 to supply a printer print head (not shown) of a printer 50. Both the vent pipe 10 and fluid supply conduit 12 have deformable side walls. In the illustrated disclosure the print fluid tank 4 is disposed inside a printer housing 14 so as to be included within the printer housing footprint. The main tank 6 has a transparent window 16 through which the level of print fluid 9 in the main tank 6 may be viewed. The print fluid tank 4 is mounted to an interior side of a wall 18 of the printer housing 14. The wall 18 includes a viewing portion 20 through which transparent window 16 may be viewed. The wall 18 is hingedly mounted 22 to the printer housing 14 and includes an arm 24 extending from a side of the hinge 22 opposite the main part of the wall 18. The arm 24 includes a bump 26 to form a contact element.

In a print fluid supply orientation the wall 18 is in an upright and closed position relative to the printer housing 14. Vent pipe 10 and print fluid supply conduit 12 are routed between the arm 24 and an interior wall 28 of the printer housing 14. The print fluid storage tank 4 may be moved into a horizontal fill position by pivoting wall 18 about the hinge 22, illustrated in FIG. 2, for filling the main tank 6 with print fluid through a fill aperture 30. In the fill position bump 26 on the arm 24 engages with the vent pipe 10 and the print fluid supply conduit 12 against an anvil 27 to deform the side walls of the vent pipe 10 and fluid supply conduit 12 to close them in the manner of a pinch valve. The action of moving print fluid storage tank 4 to the fill position for providing access to the fill aperture 30 causes operation of the pinch valve to close the vent pipe 10 and the fluid supply conduit 12

Stopper 32 may be removed from aperture 30 when the print fluid storage tank 4 is in the fill position and the vent pipe 10 and fluid supply conduit 12 closed so that back pressure on a print fluid delivery system 28 to the print head (not shown) is maintained. The position of the fill aperture 30 is such that when the print fluid storage tank 4 is in the horizontal fill position it is outside of the edge 25 of the printer housing 14. Therefore any spillages of print fluid from unit 19 while refilling occurs outside of the edge 25 of the printer housing 14 and will reduce or eliminate the requirement to clean the inside of the printer. Print fluid spillages are also reduced during transportation if shipped in this position.

After refilling the print fluid the stopper 32 is replaced into fill aperture 30 to seal print fluid tank 4. The print fluid storage tank 4 may be moved to pivot about the hinge 22 into a vertical operating position which resets the bubbler level so that the system is ready to supply a constant flow of print fluid.

FIG. 3 is an illustrative schematic of print fluid supply conduit 12 and vent pipe 10 when the print fluid storage tank 4 is in the fill position. The bump 26 presses against the printer housing 14 which deforms vent pipe 10 and print fluid supply conduit 12 to close them by deforming the sidewalls.

As used herein any reference to "one disclosure" or "a disclosure" means that a particular element, feature, structure, or characteristic described in connection with the disclosure is included in at least one disclosure. The appearances of the phrase "in one disclosure" or the phrase "in a disclosure" in various places in the specification are not necessarily all referring to the same disclosure.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the disclosure. This is done merely for convenience and to give a general sense of the disclosure. This description should be read to include one or at least one and the singular also includes the plural unless it is obvious that it is meant otherwise.

Various modifications may be made within the scope of the disclosure. For example, a valve other than a pinch valve may be used such as a rotary cut-off valve or valve operated in response to a rotation motion. Although examples of the disclosure have been described with reference to a horizontal fill position the hinge may be disposed to a side of the wall 18 in a vertical orientation. A pinch valve or other rotary motion activated cut-off valve may be operated by movement of the wall 18 to place print fluid storage tank 4 in a position away from the printer housing and in a vertical fill position. The print fluid storage tank 4 may also be removably mounted to the wall 18 or formed integral therewith.

The scope of the present disclosure includes any novel feature or combination of features disclosed therein either explicitly or implicitly or any generalisation thereof irrespective of whether or not it relates to the claimed subject matter or mitigates against any or all of the issues addressed by the present disclosure. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

What is claimed is:

1. An apparatus comprising:

a tank to store a print fluid;

a print fluid supply conduit coupled to the tank to supply the print fluid to a print fluid delivery system; and a vent conduit extending from the tank, wherein the tank is pivotably movable from a first position to a second position, wherein in the first position the tank is to supply the print fluid and the print fluid supply conduit and the vent conduit are open, wherein in the second position a fill aperture of the tank is accessible to permit filling of the tank, and wherein a pivotal movement of the tank from the first position to the second position closes the print fluid supply conduit and the vent conduit.

2. The apparatus of claim 1, wherein the tank comprises a bubbler tank, and wherein the vent conduit extends from the bubbler tank.

3. The apparatus of claim 2, wherein the pivotal movement of the tank from the first position to the second position maintains a pressure in the bubbler tank.

4. The apparatus of claim 1, wherein the tank is pivotably movable between a vertical position and a horizontal position, wherein the first position is one of the vertical position and the horizontal position, and the second position is the other of the vertical position and the horizontal position.

5. The apparatus of claim 1, further comprising a valve mechanism in mechanical cooperation with the tank to close the print fluid supply conduit and close the vent conduit responsive to the pivotal movement of the tank from the first position to the second position.

6. The apparatus of claim 5, wherein the valve mechanism comprises a pinch valve mechanism.

7. The apparatus of claim 6, wherein the print fluid supply conduit and the vent conduit comprise collapsible walls and are disposed between an arm and an anvil of the pinch valve mechanism such that the pivotal movement of the tank from the first position to the second position causes the arm to collapse the walls of the print fluid supply conduit and the vent conduit against the anvil.

8. The apparatus of claim 7, wherein the arm has a bump that engages the print fluid supply conduit and the vent conduit to collapse the walls of the print fluid supply conduit and the vent conduit.

9. The apparatus of claim 7, wherein the arm is pivotable with the pivotal movement of the tank.

10. The apparatus of claim 9, wherein the arm is coupled to a hinge and is pivotable about the hinge.

11. The apparatus of claim 10, wherein the arm is part of a wall that pivots with the tank, and wherein the print fluid supply conduit and the vent conduit extend through a space between the anvil and the wall.

12. The apparatus of claim 1, wherein in the first position the fill aperture of the tank is inaccessible.

13. A printer comprising:

a housing;

a print fluid delivery system;

a tank to store a print fluid, a print fluid supply conduit coupled to the tank to supply the print fluid to the print fluid delivery system;

a vent conduit extending from the tank, wherein the tank is pivotally movable from a first position to a second position, wherein in the first position the tank is to supply the print fluid and the print fluid supply conduit and the vent conduit are open, wherein in the second position a fill aperture of the tank is accessible to permit filling of the tank, and wherein a pivotal movement of the tank from the first position to the second position closes the print fluid supply conduit and the vent conduit, and wherein the tank is disposed within the housing in the first position and outside the housing in the second position.

14. The printer of claim 13, comprising an arm and an anvil, wherein the anvil comprises an inner wall of the housing and the arm is pivotable with the pivotal movement of the tank from the first position to the second position to bring the arm into a position to cause the arm to collapse walls of the print fluid supply conduit and the vent conduit against the anvil.

15. The printer of claim 14, wherein the arm and the anvil are part of a pinch valve mechanism.

16. The printer of claim 14, wherein the arm is coupled to a hinge and is pivotable about the hinge.

17. The printer of claim 16, wherein the arm is part of a wall that pivots with the tank, and wherein the print fluid supply conduit and the vent conduit extend through a space between the anvil and the wall.

18. The printer of claim 13, wherein the tank is integral to the housing.

19. The printer of claim 13, wherein the tank is pivotably movable between a vertical position and a horizontal position, wherein the first position is one of the vertical position and the horizontal position, and the second position is the other one of the vertical position and the horizontal position.

20. A method comprising:

providing a tank storing a print fluid is in a first position in a printer, supplying the print fluid through a print fluid supply conduit to a print fluid delivery system of the printer, wherein a vent conduit extends from the tank; and pivoting the tank from the first position to a second position, wherein in the first position of the tank the print fluid supply conduit and the vent conduit are open, wherein in the second position of the tank a fill aperture of the tank is accessible to permit filing of the tank, and wherein the pivoting of the tank from the first position to the second position closes the print fluid supply conduit and the vent conduit.

* * * * *